United States Patent [19]

Hayashi

[11] 4,373,485

[45] Feb. 15, 1983

[54] CARBURETOR FOR AN INTERNAL COMBUSTION ENGINE

[75] Inventor: Yoshimasa Hayashi, Kamakura, Japan

[73] Assignee: Nissan Motor Company, Limited, Yokohama, Japan

[21] Appl. No.: 265,405

[22] Filed: May 20, 1981

[30] Foreign Application Priority Data

Jul. 14, 1980 [JP] Japan ..... 55-99040[U]
Jul. 15, 1980 [JP] Japan ..... 55-99530[U]

[51] Int. Cl.[3] ..... F02M 11/04

[52] U.S. Cl. ..... 123/340; 74/860; 123/401; 261/23 A

[58] Field of Search ..... 123/336, 340, 376, 378, 123/396, 398, 401, 584; 261/23 A, DIG. 18; 74/860

[56] References Cited

U.S. PATENT DOCUMENTS 2,376,732 5/1945 Strebinger ..... 261/23 A
2,609,807 9/1952 Winkler .
2,789,801 4/1957 Durbin .
2,871,001 1/1959 Stoltman ..... 261/23 A
2,990,822 7/1961 Cramer ..... 261/23 A
2,990,824 7/1961 Cramer ..... 261/23 A
2,991,053 7/1961 Cramer ..... 261/23 A
3,756,209 9/1973 Hida et al. ..... 261/23 A X
3,811,418 5/1974 Sakakibara .
3,903,211 9/1975 Kono et al. ..... 261/23 A
3,943,906 3/1976 Hirose et al. .
4,146,593 3/1979 Higashigawa ..... 261/23 A
4,169,871 10/1979 Eason .
4,198,356 4/1980 Takimoto .

FOREIGN PATENT DOCUMENTS 2228159 11/1974 France .
52-73240 6/1977 Japan ..... 261/23 A

*Primary Examiner*—Tony M. Argenbright
*Attorney, Agent, or Firm*—Schwartz, Jeffery, Schwaab, Mack, Blumenthal & Koch

[57] ABSTRACT

A carburetor for an automotive internal combustion engine has primary and secondary barrels, each of which contains an air intake passage, a venturi and a throttle valve arranged in the air intake passage. The secondary throttle valve is adapted to open in response to the resultant of the primary and secondary venturi vacuums. The opening of the secondary throttle valve is, however, obstructed to suppress an unnecessarily rapid increase of engine speed.

6 Claims, 3 Drawing Figures

CARBURETOR FOR AN INTERNAL COMBUSTION ENGINE

BACKGROUND OF THE INVENTION

1. Field of the Invention

This invention relates to a carburetor for the internal combustion engine of an automotive vehicle, which enables the engine operating noise to be reduced when the vehicle is rapidly accelerated with a low-speed gear engaged in the automobile's transmission.

2. Description of the Prior Art

In a conventional carburetor for an automotive internal combustion engine consisting of primary and secondary barrels, the secondary barrel comes into operation when the engine is required to produce high power, whereas the primary barrel alone supplies the airfuel mixture at all other times. The secondary throttle valve is driven by an actuator responsive to the resultant of the primary and secondary venturi vacuums. The secondary throttle valve is designed to open wider as the primary venturi vacuum becomes greater.

Thus, with a low-speed gear being engaged in the automobile's transmission, when the primary throttle valve is opened wide, the secondary throttle valve is usually opened almost simultaneously, because the low-speed gear permits the engine speed to increase rapidly. However, the higher the engine speed, the louder the engine operating noise.

When the automobile is driven at high speed with the engine developing high power, the engine operating noise is not a main component of the total automobile noise, since noise caused by automobile body vibration from contact with the road surface and by passing through the air is great relative to the engine operating noise. However when the automobile is driven at a low speed with the engine developing high power, for example under rapid acceleration or when climbing a slope, the engine operating noise is a main component of the total automobile noise, since the other noise is small relative to the engine operating noise.

When the automobile equipped with such a conventional carburetor is accelerated hard with a low-speed gear being engaged, the engine operating noise forms, for instance, 50 to 70 percent of the total automobile noise.

SUMMARY OF THE INVENTION

It is an object of the present invention to provide a carburetor for the internal combustion engine of an automotive vehicle which enables a reduction of the total noise thereof when the vehicle is fully accelerated with a low-speed gear engaged in the transmission thereof.

The carburetor of the present invention has primary and secondary barrels. Each barrel contains an air intake passage, a venturi and a throttle valve arranged in the air intake passage. The secondary throttle valve is adapted to open in response to the resultant of the primary and secondary venturi vacuums. The opening of the secondary throttle valve is, however, obstructed to suppress an unnecessarily rapid increase of the engine speed.

The above and other objects, features and advantages of the present invention will be apparent from the following description of preferred embodiments thereof, taken in conjunction with the drawings.

DETAILED DESCRIPTION OF THE PREFERRED EMBODIMENTS

Figure 1:
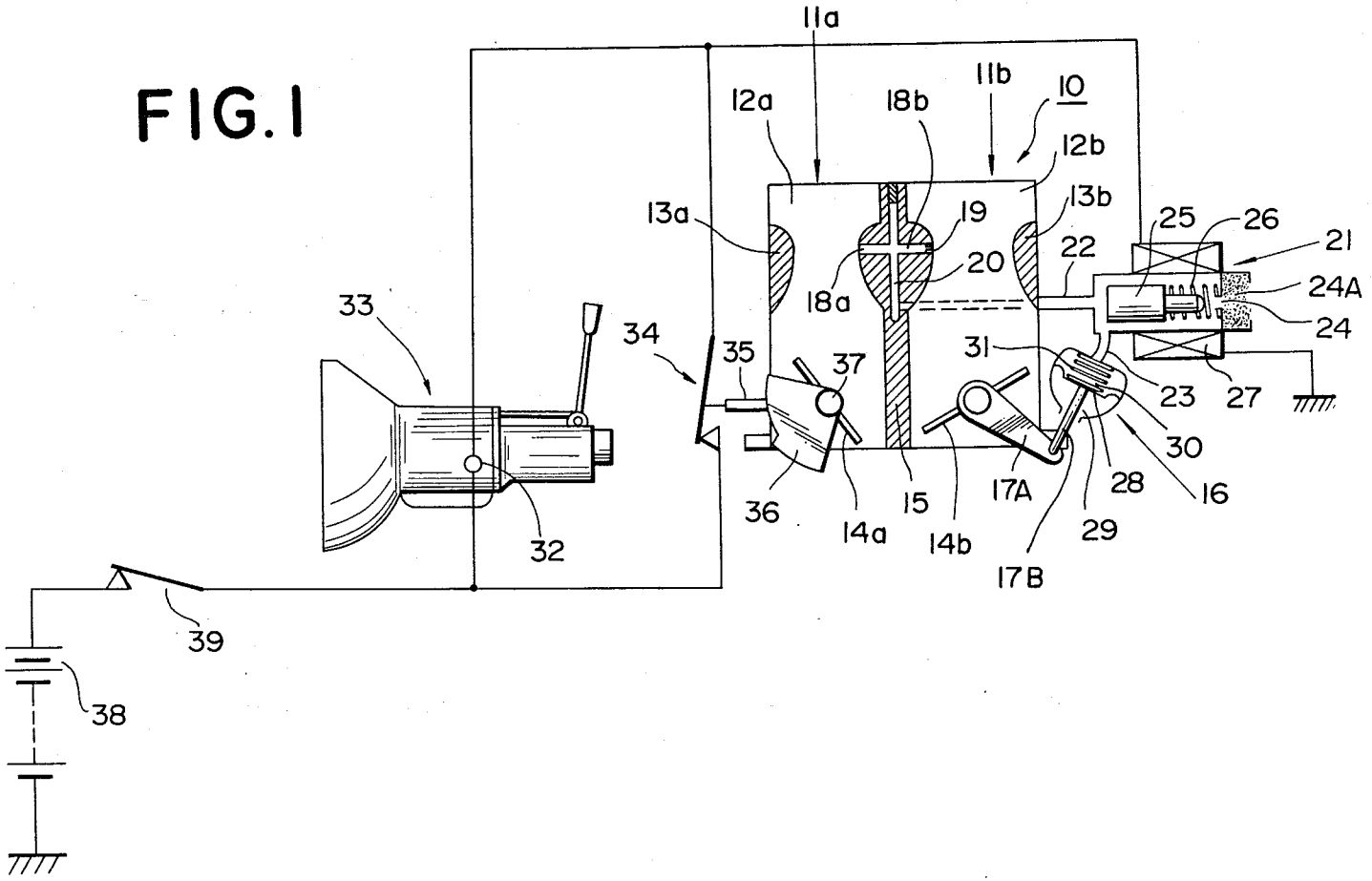
FIG. 1 is a diagrammatic sectional view of a carburetor for an automotive internal combustion engine according to a first embodiment of the present invention.

Reference is made to FIG. 1, where is illustrated a carburetor 10 for the internal combustion engine of an automotive engine according to a first embodiment of the present invention. The carburetor 10 has primary and secondary barrels 11*a* and 11*b* respectively. The primary barrel 11*a* contains an air intake passage 12*a* connected to the engine, a venturi 13*a* formed on the inside of the passage 12*a*, and a butterfly throttle valve 14*a* disposed in the passage 12*a* downstream of the venturi 13*a*. The secondary barrel 11*b* similarly contains an air intake passage 12*b* connected to the engine, a venturi 13*b*, and a butterfly throttle valve 14*b*.

The primary and secondary air intake passages 12*a* and 12*b* are separated from each other by a partition wall 15. The primary throttle valve 14*a* is linked to an accelerator pedal (not shown) so as to be operated by the same in the customary way. The secondary throttle valve 14*b* is connected to a vacuum responsive actuator 16 by a lever 17A and a stem 17B so as to be operated by the acutator 16. The secondary throttle valve 14*b* is permitted to start opening when the primary throttle valve 14*a* is opened to a predetermined angle, for example 36°, turning a secondary throttle valve stopper (not shown) to its rest position.

The partition wall 15 has therein primary and secondary vacuum inlets 18*a* and 18*b* which open into the venturis 13*a* and 13*b* respectively to introduce the respective venturi caused vacuums (referred to as venturi vacuums in the specification). The secondary vacuum inlet 18*b* has an orifice 19 at its open end. The vacuum inlets 18*a* and 18*b* are connected together by a passage 20 in the partition wall 15, which passage 20 is connected in turn to an electrically-driven three-way valve 21 by a line 22. Thus the resultant of the two venturi vacuums is introduced into the three-way valve 21. The orifice 19 prevents a drop in the primary venturi vacuum when the secondary venturi 13*b* induces substantially no vacuum. The primary and secondary barrels 11*a* and 11*b* are provided with respective fuel supply systems (not shown) in the customary way.

The three-way valve 21 is also connected to the actuator 16 by a line 23 and has an opening 24 to direct atmospheric pressure therein through a filter 24A. The three-way valve 21 further has therein a valve member 25 with a return spring 26, and a control winding 27. The three-way valve 21 is so arranged that the valve member 25 is moved against the spring 26 to establish communication between the lines 22 and 23 while closing the opening 24 when the winding 27 is energized, whereas the valve member 25 is returned by the spring 26 to establish communication between the line 23 and the opening 24 while closing the line 22 when the winding 27 is de-energized. Thus the three-way valve 21 supplies the actuator 16 with the resultant vacuum when energized, and with atmospheric pressure when de-energized.

The actuator 16 has a diaphragm 28 dividing the inside thereof into first and second chambers 29 and 30. The first chamber 29 opens to the atmosphere to introduce therein atmospheric pressure. The second chamber 30 communicates with the three-way valve 21 via the line 23 to direct therein the resultant vacuum or atmospheric pressure in response to the operation of the three-way valve 21. The diaphragm 28 thus responds to the pressure introduced into the second chamber 30. The diaphragm 28 is biased by a return spring 31 and is connected to the lever 17A by the stem 17B to operate the secondary throttle valve 14*b*. The actuator 16 is so arranged that as the vacuum introduced into the second chamber 30 increases, the diaphragm 28 along with the stem 17B will be displaced upwards against the spring 31 to open the secondary throttle valve 14*b*.

A known sensing switch 32 detecting whether or not low-speed gear is engaged is mounted on the transmission 33 of the vehicle. If the transmission 33 is of the four-speed type having first, second, third, fourth-speed and reverse gears, the sensing switch 32 is designed to turn off only when the second-speed gear is engaged.

A throttle valve switch 34 is provided to detect a predetermined degree of opening of the primary throttle valve 14*a*. The switch 34 engages a slideable plunger 35 abutting against a cam 36 mounted on the primary throttle valve shaft 37. The switch 34 is thus operated according to the rotation of the throttle valve shaft 37. The cam 36 is so formed that the switch 34 will be turned off when the primary throttle valve 14 is opened to a position close to its fully opened position.

The positive terminal of a storage battery 38 is connected to one terminal of the control winding 27 of the three-way valve 21 through an engine ignition switch 39 and the throttle valve switch 34. The negative terminal of the battery 38 and the other terminal of the control winding 27 are grounded. The sensing switch 32 is connected in parallel with the throttle switch 34. Thus the three-way valve 21 is actuated in response to either or both of the switches 32 and 34.

In operation, when the sensing switch 32 or the throttle valve switch 34 is on, the control winding 27 of the three-way valve 21 is energized to introduce the resultant of the respective venturi vacuums into the actuator 16. The secondary throttle valve 14*b* is thus opened at an angle depending upon the balance between the resultant vacuum and the return spring 31, provided that the primary throttle valve 14*a* is opened wider than the predetermined opening angle which turns the secondary throttle valve stopper (not shown) to its rest position.

When the primary throttle valve 14*a* is further opened to a position close to its fully opened position to accelerate the automobile with the low-speed gear engaged in the transmission 33, both the switches 32 and 34 are off, so that the control winding 27 of the three way valve 21 is de-energized to introduce atmospheric pressure into the actuator 16. The secondary throttle valve 14*b* is then closed, and consequently the power output of the engine falls, lowering the engine speed. Thus the total vehicle noise mainly due to engine operation is suppressed and additionally the fuel consumption performance is improved.

However, when the automobile is accelerated with the high-speed gear engaged in the transmission 33, the sensing switch 32 is not turned off. The control winding 27 of the three-way valve 21 is thus always energized to introduce the resultant vacuum into the actuator 16 to open the secondary throttle valve 14*b*. Therefore, the acceleration response of the vehicle is not impaired in the relatively high-speed range.

Figure 2:
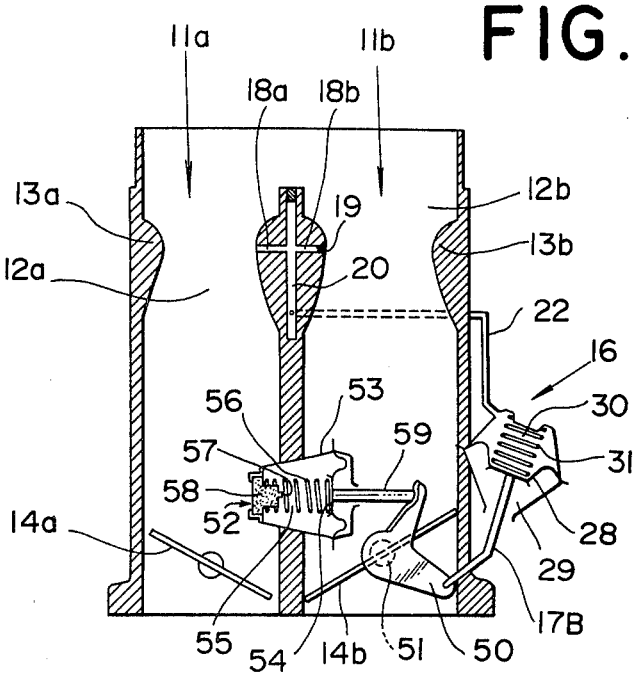
FIG. 2 is a diagrammatic sectional view of a carburetor according to a second embodiment of the present invention.

In FIG. 2 is illustrated a carburetor of a second embodiment of the present invention, wherein corresponding or similar parts are designated by the same numbers as those of FIG. 1 to omit descriptions thereof.

The line 22 is directly connected to the second chamber 30 of the actuator 16 to introduce the resultant of the respective venturi vacuums into the actuator 16. An L-shaped lever 50 mounted on the secondary throttle valve shaft 51 is connected at one end to the stem 17B. A diaphragm device 52 is provided to obstruct the opening of the secondary throttle valve 14*b*. The device 52 has a casing 53, a diaphragm 54 forming a working chamber 55 within the casing 53, and a return spring 56 biasing the diaphragm 54. The side of the diaphragm 54 opposite to the working chamber 55 is subjected to atmospheric pressure. The working chamber 55 opens to the atmosphere through an orifice 57 formed through the wall of the casing 53 and a filter 58. One end of a rod 59 is fixed to the diaphragm, and the other end rests against the other end of the lever 50.

Since the orifice 57 restricts the rate of air flow therethrough, displacement of the diaphragm 54 and the rod 59 is obstructed. In this embodiment, the orifice 57 is so arranged that the displacement speed of the rod 59 is limited to a relatively low speed. Thus the device 52 obstructs the opening of the secondary throttle valve 14*b*.

In operation, when the primary throttle valve 14*a* is opened rapidly with the low-speed gear engaged in the transmission to operate the vehicle under for example, an upward slope, the engine speed increases rapidly so that the primary venturi vacuum also rises rapidly. However, the actuator 16 opens the secondary throttle valve 14*b* at a relatively low speed, since the device 52 will obstruct the opening of the secondary throttle valve 14*b*. After a preset time determined by the device 52, the secondary throttle valve 14*b* is opened to a required angle, thereby obtaining the required engine power. Thus the increase of the engine speed is suppressed by the restriction on the secondary throttle valve's rate of opening, and consequently the rise of vehicle noise is also suppressed.

Limitation characteristics for the throttle valve opening speed of the device 52 are preferably designed with consideration to the fact that the acceleration of the automobile with the low-speed gear engaged is usually only for less than ten seconds. The secondary throttle valve 14*b* is allowed to close quickly, since the lever 50 can move away from the rod 59. When the automobile is acclerated with the high-speed gear engaged in the transmission, the acceleration performance is not so impaired since the secondary throttle valve 14*b* is already opened wide at the start of acceleration.

Figure 3:
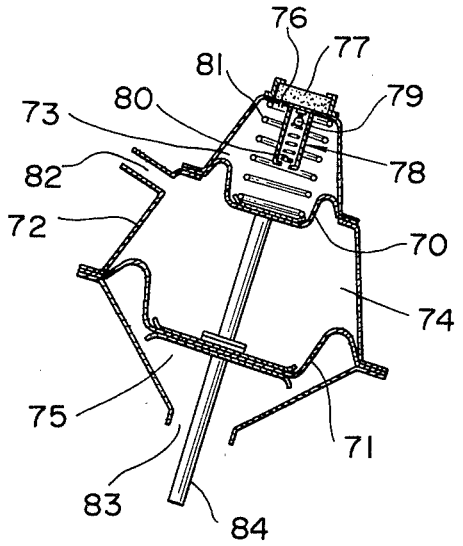
FIG. 3 is a diagrammatic sectional view of an essential part of a carburetor according to a third embodiment of the present invention.

In FIG. 3 is illustrated an essential part of a third embodiment of the present invention, wherein a diaphragm device is formed integrally with an actuator while the other parts are similar to those of the carburetor shown in FIG. 2 and consequently description and illustration thereof are omitted.

First and second diaphragms 70 and 71 divide the inside of a casing 72 into first, second and third chambers 73, 74 and 75, respectively. The first chamber 73 opens to the atmosphere through an orifice 76 and a filter 77 and also through a check valve 78, parallel to the orifice 76, and the filter 77. The check valve 78 arranged within the first chamber 73 includes a valve member 79 and a return spring 80 biasing the valve member 79. Inside the first chamber 73 a return spring 81 is disposed to bias the first diaphragm 70.

The second chamber 74 between the diaphragms 70 and 71 has an inlet 82 through which the resultant of the primary and secondary venturi vacuums is directed to the second chamber 74. The third chamber 75 has a large opening 83 to direct therein the atmospheric pressure. A stem 84 is fixed to the second diaphragm 71 and extends sealingly through the same to be fixed to the first diaphragm 70 at one end, the other end of the stem 84 being connected to a lever mounted on the secondary throttle valve shaft (see FIG. 2). The effective area of the first diaphragm 70 is less than that of the second diaphragm 71 so that the stem 84 will move upwards to open the secondary throttle valve as the resultant vacuum introduced to the second chamber 74 rises.

When the stem 84 moves upwards to open the secondary throttle valve, the secondary throttle valve is in fact opened slowly since the check valve 78 is adjusted to close to allow discharge of the air from the first chamber 73 to the outside only through the orifice 76, thereby moving the stem 84 slowly.

On the other hand, when the stem 84 moves downwards, the secondary throttle valve closes quickly since the check valve 78 is opened to admit air into the first chamber 73.

In this manner, the carburetor of the third embodiment functions similarly to the afore-mentioned second embodiment and produces the same effect as that of the second embodiment.

It should be understood that further modifications and variations may be made in the present invention without departing from the spirit of the present invention as set forth in the appended claims.

What is claimed is:

1. A carburetor for an internal combustion engine of an automotive vehicle, the vehicle being equipped with a transmission, the carburetor comprising:

(a) primary and secondary barrels, the primary barrel comprising, (1) a primary air intake passage, (2) a primary venturi arranged in the primary air intake passage, (3) a primary throttle valve arranged in the primary air intake passsage downstream of the primary venturi, the secondary barrel comprising, (4) a secondary air intake passage, (5) a secondary venturi arranged in the secondary air intake passage, (6) a secondary throttle valve arranged in the secondary air intake passage downstream of the secondary venturi;

(b) a vacuum responsive actuator connected to the secondary throttle valve to operate the same;

(c) a passageway opening to the primary and secondary venturis for obtaining a resultant of the primary and secondary venturi vacuums and introducing the resultant vacuum into the actuator so that the secondary throttle valve will be opened as the resultant vacuum rises;

(d) a sensor for detecting whether a low-speed gear is engaged in the transmission; and (e) a valve responsive to the sensor for controlling the introduction of the resultant vacuum into the actuator;

whereby the secondary throttle valve is closed irrespective of the resultant vacuum when the low-speed gear is engaged in the transmission.

2. A carburetor as defined by claim 1, further comprising a second sensor for detecting whether the primary throttle valve is opened wider than a predetermined degree of opening, the control valve also responsive to the second sensor, whereby the secondary throttle valve is closed irrespective of the resultant vacuum when the low-speed gear is engaged and also the primary throttle valve is opened wider than the predetermined degree of opening.

3. A carburetor as defined by claim 2, wherein the control valve interposed in the passageway is adapted to selectively introduce the resultant vacuum or atmospheric pressure into the actuator so that the secondary throttle valve will be closed when the control valve introduces atmospheric pressure into the actuator.

4. A carburetor of an internal combustion engine of an automotive vehicle, comprising:

(a) primary and secondary barrels, the primary barrel comprising, (1) a primary air intake passage, (2) a primary venturi arranged in the primary air intake passage, (3) a primary throttle valve arranged in the primary air intake passage downstream of the primary venturi, the secondary barrel comprising, (4) a secondary air intake passage, (5) a secondary venturi arranged in the secondary air intake passage, (6) a secondary throttle valve arranged in the secondary air intake passage downstream of the secondary venturi;

(b) a vacuum responsive actuator connected to the secondary throttle valve to operate the same;

(c) a passageway opening to the primary and secondary venturis for obtaining the resultant of the primary and secondary venturi vacuums and introducing the resultant vacuum into the actuator so that the secondary throttle valve will be opened as the resultant vacuum rises;

(d) a diaphragm device for obstructing the opening of the secondary throttle valve, while not interfering with the closing of the secondary throttle valve.

5. A carburetor as defined by claim 4, wherein the diaphragm device comprises a casing, a diaphragm defining a chamber within the casing, the diaphragm subjected to the atmosphere on the surface opposite to the chamber, the diaphragm disconnectably engaging with the secondary throttle valve, the chamber opening to the atmosphere through an orifice, a return spring biasing the diaphragm in the direction closing the secondary throttle valve.

6. A carburetor for an internal combustion engine of an automotive vehicle, comprising:

(a) primary and secondary barrels, the primary barrel comprising, (1) a primary air intake passage, (2) a primary venturi arranged in the primary air intake passage, (3) a primary throttle valve arranged in the primary air intake passage downstream of the primary venturi, the secondary barrel comprising, (4) a secondary air intake passage, (5) a secondary venturi arranged in the secondary air intake passage, (6) a secondary throttle valve arranged in the secondary air intake passage downstream of the secondary venturi;

(b) a pressure responsive actuator comprising, (1) a casing, (2) first and second diaphragms dividing the inside of the casing into three chambers, the first diaphragm being of a lower effective area than the second diaphragm, the first chamber being formed by the casing and the first diaphragm, the first chamber opening to the atmosphere through an orifice and through a check valve parallel to the orifice, the second chamber being formed between the first and second diaphragms and the casing, the second chamber having an inlet, the third chamber being formed by the second diaphragm and the casing, and the third chamber opening to the atmosphere, (3) a rod fixed to the first and second diaphragms, the rod connected to the secondary throttle valve to drive the same, (4) a return spring biasing the first diaphragm in the direction closing the secondary throttle valve; and (c) a passageway opening to the primary and secondary venturis for obtaining the resultant of the primary and secondary venturi vacuums and introducing the resultant vacuum into the second chamber via the inlet so that the secondary throttle valve will be opened as the resultant vacuum rises to displace the first and second diaphragms;

whereby when the secondary throttle valve is opened, the check valve is closed to obstruct the displacement of the first diaphragm and thus reduce the rate of opening of the secondary throttle valve.

* * * * *